US009948040B1

(12) United States Patent
Lee et al.

(10) Patent No.: US 9,948,040 B1
(45) Date of Patent: Apr. 17, 2018

(54) CONNECTOR

(71) Applicants: LITE-ON ELECTRONICS (GUANGZHOU) LIMITED, Guangzhou (CN); Lite-On Technology Corporation, Taipei (TW)

(72) Inventors: Johnson Lee, Taipei (TW); Yao-Chung Yeh, Taipei (TW); Chia-Chih Hsu, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/660,971

(22) Filed: Jul. 27, 2017

(30) Foreign Application Priority Data

Apr. 26, 2017 (CN) ..... 2017 2 0447668 U

(51) Int. Cl.

| | |
|---|---|
| ***H01R 9/05*** | (2006.01) |
| ***H01R 24/58*** | (2011.01) |
| ***F21V 23/06*** | (2006.01) |
| ***H01R 13/11*** | (2006.01) |
| ***H01R 13/66*** | (2006.01) |
| ***H01R 24/20*** | (2011.01) |
| *H01R 107/00* | (2006.01) |

(52) U.S. Cl.
CPC ..... *H01R 24/58* (2013.01); *F21V 23/06* (2013.01); *H01R 13/111* (2013.01); *H01R 13/6683* (2013.01); *H01R 24/20* (2013.01); *H01R 2107/00* (2013.01); *H01R 2201/04* (2013.01)

(58) Field of Classification Search
CPC .... H01R 17/12; H01R 9/0521; H01R 9/0518; H01R 13/60; H01R 33/7628; H01R 13/6275; H01R 13/6397
USPC ..... 439/578, 583, 584, 585, 528, 683, 350, 439/133
See application file for complete search history.

(56) References Cited

U.S. PATENT DOCUMENTS

| | | | | |
|---|---|---|---|---|
| 7,618,275 | B2 * | 11/2009 | Owen, Sr. | F21S 48/337 439/206 |
| 7,635,208 | B2 * | 12/2009 | Hedrick | F21L 14/02 16/110.1 |
| 7,666,036 | B1 * | 2/2010 | Zou | F21V 19/0005 362/653 |
| 7,690,950 | B2 * | 4/2010 | Owen, Sr. | B60R 16/0207 439/336 |

(Continued)

*Primary Examiner* — Phuong Chi T Nguyen
(74) *Attorney, Agent, or Firm* — JCIPRNET

(57) ABSTRACT

A connector includes an insulated housing, four connecting terminals, three pins and a plug. The insulated housing has a containing space and a disposing surface, and the disposing surface is located in the containing space. The connecting terminals are separately disposed in the containing space of the insulated housing and located on the disposing surface. The pins are separately disposed in the containing space of the insulated housing and extend from the disposing surface toward a direction away from the disposing surface, and the connecting terminals surround the pins. The plug is disposed in a center of the containing space of the insulated housing and located on the disposing surface. The plug is beneficial to rotate and has no directionality. The plug includes a plurality of conductive rings, the conductive rings are separately arranged along the direction away from the disposing surface, and the pins surround the plug.

9 Claims, 4 Drawing Sheets

(56) References Cited

U.S. PATENT DOCUMENTS

| | | | | |
|---|---|---|---|---|
| 7,736,174 | B2 * | 6/2010 | Bhosale | F21V 33/00 365/95 |
| 7,740,503 | B1 * | 6/2010 | Tsai | H01R 33/09 362/257 |

* cited by examiner

CONNECTOR

CROSS REFERENCE TO RELATED APPLICATION

This application claims the priority benefit of China application serial no. 201720447668.X, filed on Apr. 26, 2017. The entirety of the above-mentioned patent application is hereby incorporated by reference herein and made a part of specification.

BACKGROUND OF THE INVENTION

Field of the Invention

The invention relates to a connector, and more particularly relates to a connector applied to lighting fixtures.

Description of Related Art

Existing street lights (mainly in North America) mostly adopt a connector of NEMA 7 (ANSI 136.41) specification, connecting a control component to the connector of ANSI 136.41 specification, such that the control component connects to an internal circuit of the street light through the connector, so as to achieve a purpose of controlling the street light. Currently, the connector of ANSI 136.41 specification only has 7 pins in total, and does not have spare pins providing for definition of a control means and transmission of a high frequency signal, resulting in existing street lights not being easily updated to smart network control. If existing connectors of ANSI 136.41 specification were to be completely replaced, it would not take a short time to achieve and would require exceedingly high costs.

SUMMARY OF THE INVENTION

The invention provides a connector having an effect of transmitting a high frequency signal and compatible with current light fixtures (such as street lights).

The connector of the invention is suitable to be disposed on a lighting fixture. The connector includes an insulated housing, four connecting terminals, three pins, and a plug. The insulated housing has a containing space and a disposing surface, and the disposing surface is located in the containing space. The connecting terminals are separately disposed in the containing space of the insulated housing and located on the disposing surface. The pins are separately disposed in the containing space of the insulated housing, and extend from the disposing surface toward a direction away from the disposing surface, and the connecting terminals surround the pins. The plug is disposed in a center of the containing space of the insulated housing and located on the disposing surface. The plug includes a plurality of conductive rings, the conductive rings are separately arranged along the direction away from the disposing surface, and the pins surround the plug.

In an embodiment of the invention, a first perpendicular height from each of the connecting terminals to the disposing surface is less than a second perpendicular height from each of the pins to the disposing surface, and a third perpendicular height from the plug to the disposing surface is less than the second perpendicular height and greater than the first perpendicular height.

In an embodiment of the invention, the pins include two first pins and one second pin, a width of the second pin being greater than a width of each of the first pins.

In an embodiment of the invention, the conductive rings transmit a signal using an Internet of Things communication protocol.

In an embodiment of the invention, the connector further includes a base, four connection pads, three pin slots, and a plug slot. The base is assembled on the insulated housing and has a connection surface. The connection pads are disposed on the connection surface of the base, and the connecting terminals connect to the connection pads. The pin slots are disposed on the connection surface of the base, and the pins are respectively plugged into the pin slots. The plug slot is disposed on the connection surface of the base and has a plurality of conductive spring sheets. The plug is plugged into the plug slot, such that the conductive rings respectively contact the conductive spring sheets.

In an embodiment of the invention, an external diameter of the base is less than an internal diameter of the insulated housing, and a portion of the base is located in the containing space of the insulated housing.

In an embodiment of the invention, the connector further includes a plurality of transmission pins. The transmission pins are disposed on another side of the base relatively away from the connection surface, and electrically connected to the connection pads, the pin slots, and the plug slot, respectively.

In an embodiment of the invention, the connector further includes a control unit. The control unit is disposed in the insulated housing, the control unit including a light sensor or a wireless signal receiver.

In an embodiment of the invention, the connector further includes an Internet of Things device, disposed in the insulated housing.

In an embodiment of the invention, the plug is a cylindrical plug.

Accordingly, in the design of the connector of the invention, besides the existing four connecting terminals and three pins, a plug is further included, and the plug includes the plurality of conductive rings. Therefore, compared to a connector of traditional ANSI 136.41 specification having only 7 pins, the connector of the invention further has the plug, the conductive rings thereof providing for definition of a control means and transmission of the high frequency signal. Furthermore, since the connector of the invention adds a plug based on a connector of existing ANSI 136.41 specification, the connector of the invention is compatible with existing lighting fixtures.

To make the above and other features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
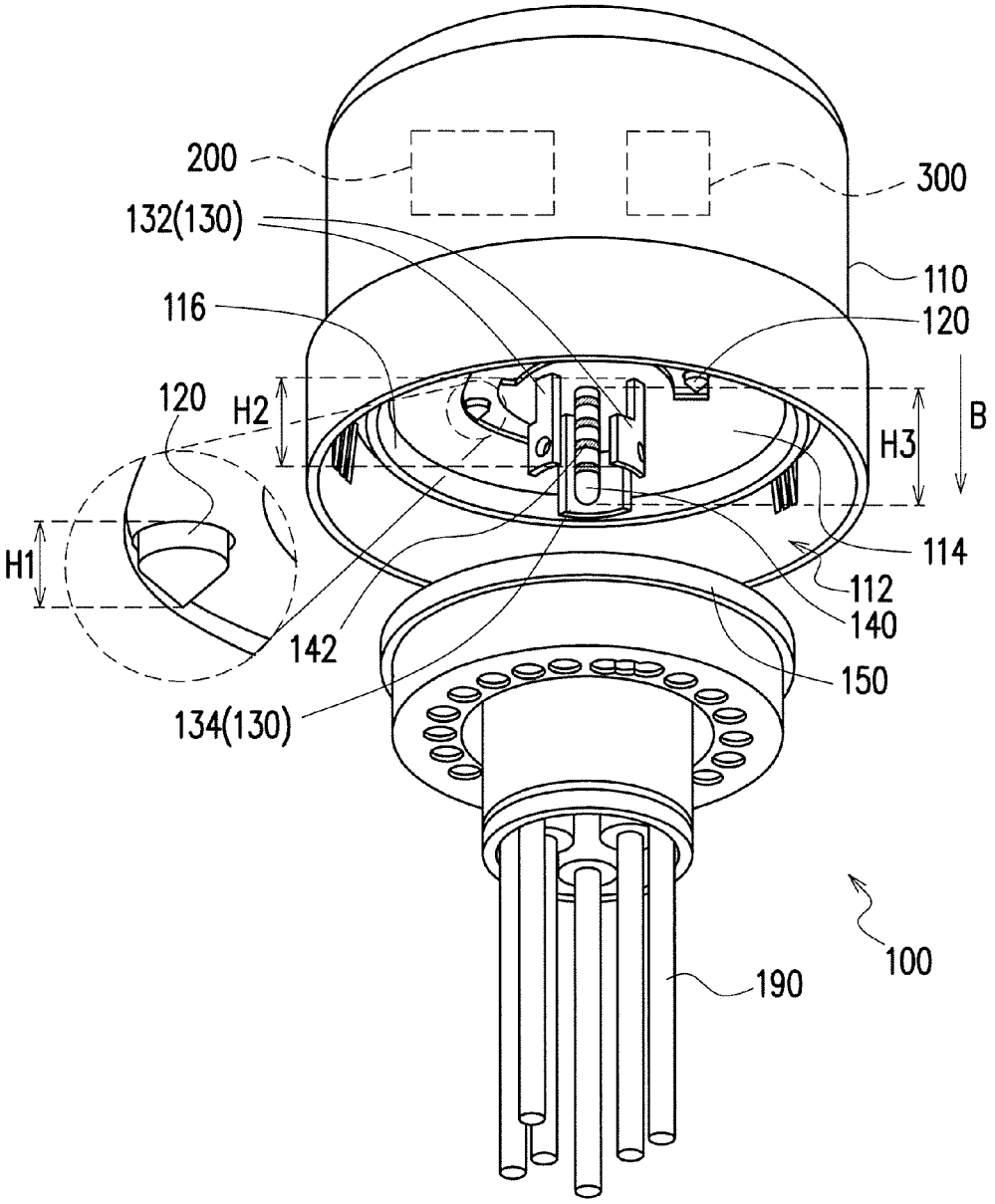
FIG. 1 illustrates a partial perspective exploded schematic diagram of a connector of an embodiment of the invention.
Figure 2:
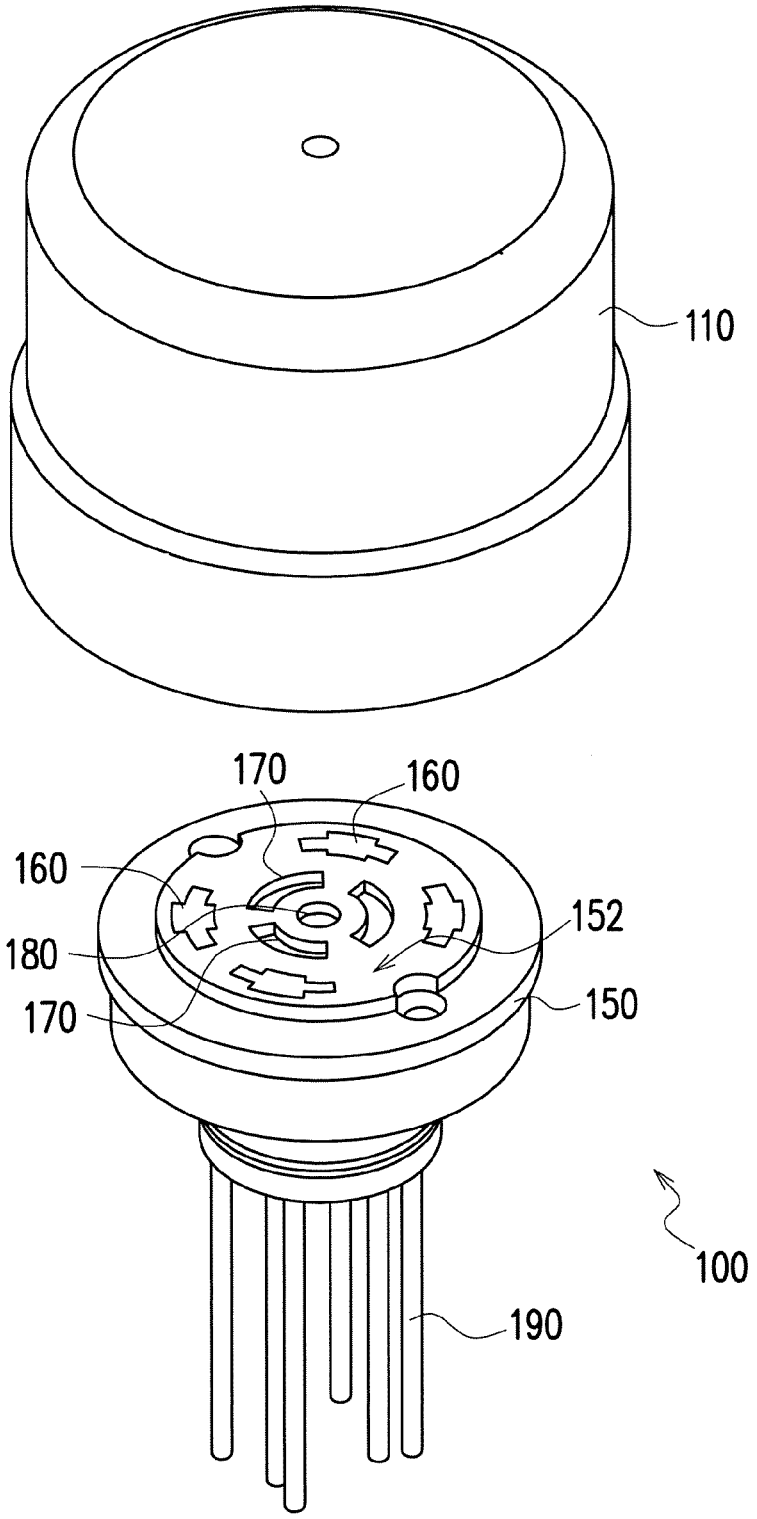
FIG. 2 illustrates a partial perspective exploded schematic diagram of another angle of view of the connector of FIG. 1.
Figure 3:
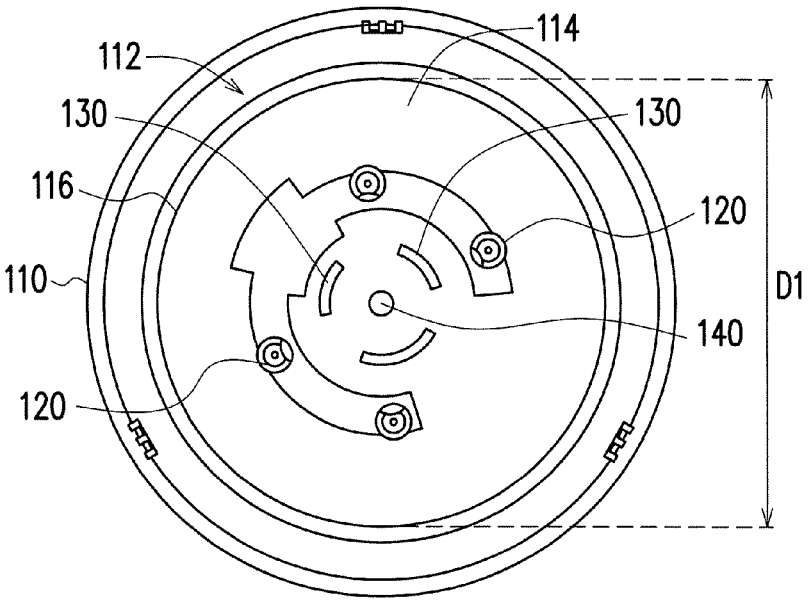
FIG. 3 illustrates a bottom-view schematic diagram of an insulated housing of FIG. 1.
Figure 4:
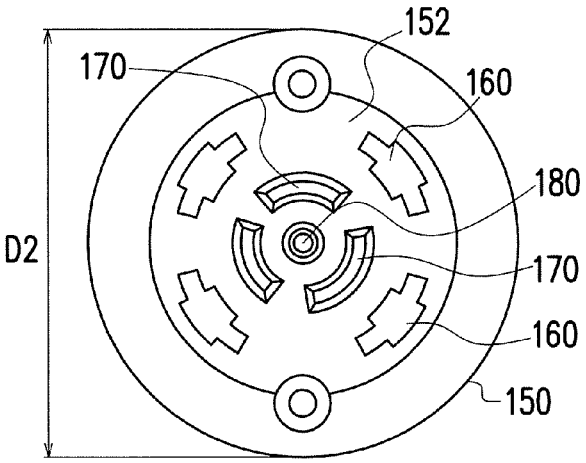
FIG. 4 illustrates a top-view schematic diagram of a base of FIG. 1.
Figure 5:
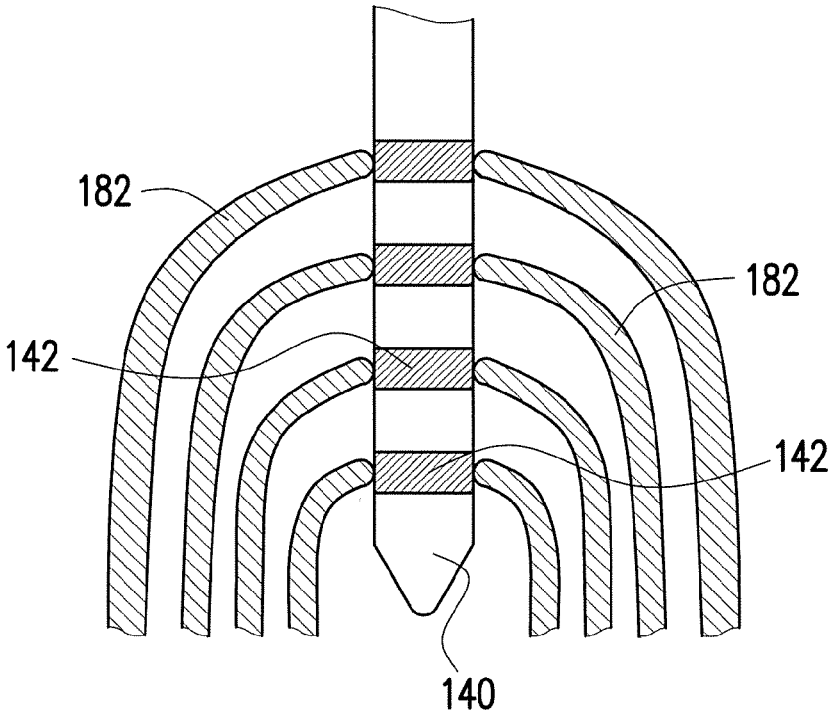
FIG. 5 illustrates a connection schematic diagram of a plug and a spring sheet of FIG. 1.

FIG. 1 illustrates a partial perspective exploded schematic diagram of a connector of an embodiment of the invention. FIG. 2 illustrates a partial perspective exploded schematic diagram of another angle of view of the connector of FIG. 1. FIG. 3 illustrates a bottom-view schematic diagram of an insulated housing of FIG. 1. FIG. 4 illustrates a top-view schematic diagram of a base of FIG. 1. FIG. 5 illustrates a connection schematic diagram of a plug and a spring sheet of FIG. 1. Referring first to FIG. 1 and FIG. 2, a connector 100 of the embodiment is suitable to be disposed on a lighting fixture (not illustrated), wherein the lighting fixture can be, for example, a street light, but is not limited thereto.

Referring simultaneously to FIG. 1, FIG. 2, and FIG. 3, the connector 100 of the embodiment includes an insulated housing 110, four connecting terminals 120, three pins 130, and a plug 140. The insulated housing 110 has a containing space 112 and a disposing surface 114. The four connecting terminals 120 are separately disposed in the containing space 112 of the insulated housing 110 and located on the disposing surface 114. The three pins 130 are separately disposed in the containing space 112 of the insulated housing 110, wherein each of the pins 130 extend from the disposing surface 114 toward a direction B away from the disposing surface 114, and the four connecting terminals 120 surround a periphery of the three pins 130. The plug 140 is disposed in a center of the containing space 112 of the insulated housing 110 and is located at a center position on the disposing surface 114 and extends along the direction B. The plug 140 is, for example, a cylindrical plug to be beneficial to rotate and has no directionality, but the invention is not limited thereto. The plug 140 includes a plurality of conductive rings 142, and the conductive rings 142 are separately arranged along the direction B, and the three pins 130 surround a periphery of the plug 140. Furthermore, a quantity of the conductive rings 142 of the embodiment is plural, which can be, for example, two or more, such as an explanation using the four conductive rings 142 as an example in FIG. 1, but the invention is not limited thereto.

More specifically, referring again to FIG. 1, the connecting terminals 120, the pins 130, and the plug 140 protrude the disposing surface 114. A first perpendicular height H1 is between the connecting terminals 120 and the disposing surface 114; a second perpendicular height H2 is between the pines and the disposing surface 114; and a third perpendicular height H3 is between ends of the plug 140 and the disposing surface 114. Preferably, the first perpendicular height H1 is less than the second perpendicular height H2, and the third perpendicular height H3 is less than the second perpendicular height H2 and greater than the first perpendicular height H1. Furthermore, the three pins 130 include two first pins 132 and one second pin 134, wherein a width of the second pin 134 is greater than a width of each of the first pins 132, thereby achieving a foolproof purpose.

As shown in FIG. 1, the plug 140 of the embodiment includes the four conductive rings 142. The four conducting rings 142 can respectively be a $V_{BUS}$ connection point of a standard universal serial bus (USB), a D− connection point, a D+ connection point, and a ground connection point, and each of the conductive rings 142, for example, transmits the high frequency signal using an Internet of Things communication protocol, but is not limited thereto.

In addition, referring to FIG. 2, FIG. 4 and FIG. 5, the connector 100 of the embodiment further includes a base 150, four connection pads 160, three pin slots 170, and a plug slot 180. The base 150 is assembled on the insulated housing 110 and has a connection surface 152. Here, as shown in FIG. 3, the insulated housing 110 of the embodiment has an engaging wall face 116, wherein the engaging wall face 116 surroundingly forms on the disposing surface 114. A portion of the base 150 is located in the containing space 112 of the insulated housing 110 and rotatably combines with the engaging wall face 116. In the embodiment, the engaging wall face 116 of the insulated housing 110 has an internal diameter D1, and the base 150 has an external diameter D2, wherein the external diameter D2 of the base 150 is less than the internal diameter D1 of the insulated housing 110. The four connection pads 160 are disposed on the connection surface 152 of the base 150, and the connection pads 160 surround on the connection surface 152 in a mutually spaced apart manner, wherein the connecting terminals 120 are respectively connected to the corresponding connection pads 160. The three pin slots 170 are surroundingly disposed on the connection surface 152 of the base 150 and mutually spaced apart, wherein the pins 130 are respectively plugged into the pin slots 170, and the connection pads 160 surround a periphery of the pin slots 170. The plug slot 180 is disposed on the connection surface 152 of the base 150 and has a plurality of conductive spring sheets 182, wherein the plug 140 is plugged into the plug slot 180, such that the conductive rings 142 respectively contact the conductive spring sheets 182 at corresponding heights.

Furthermore, the connector 100 of the embodiment further includes a plurality of transmission pins 190 disposed on another side of the base 150 relatively away from the connection surface 152, and electrically connected to the connection pads 160, the pin slots 170, and the plug slot 180, respectively. The transmission pins 190 is plugged into the lighting fixture and is configured to transmit a signal. In addition, the connector 100 of the embodiment further includes a control unit 200 disposed in the insulated housing 110, wherein the control unit 200 is, for example, a light sensor or a wireless signal receiver. By sensing an environmental brightness or receiving a signal, the control unit 200 may switch a lighting state or an off state of the lighting fixture. More specifically, the connector 100 of the embodiment further includes an Internet of Things device 300 disposed in the insulated housing 110, wherein the Internet of Things device 300, for example, adopts the Internet of Things communication protocol and transmits the high frequency signal through the conductive rings 142 of the plug 140.

In brief, the connector 100 of the embodiment includes at least 11 pins, namely the four connecting terminals 120, the three pins 130, and the four conductive rings 142. Therefore, compared to a connector of traditional ANSI 136.41 specification having only 7 pins, the connector 100 of the embodiment further has at least 4 pins (namely, the conductive rings 142) providing for definition of a control means and transmission of the high frequency signal. In addition, the conductive rings 142 can respectively be, for example, a $V_{BUS}$ connection point of a standard universal serial bus (USB), a D− connection point, a D+ connection point, and a ground connection point, and the conductive rings 142 transmit the high frequency signal using the Internet of Things communication protocol, thus improving a range of application of the connector 100. Furthermore, since the connector 100 of the embodiment adds a plug 140 based on a connector of existing ANSI 136.41 specification, the connector 100 of the embodiment is compatible with existing lighting fixtures.

In summary of the above, in the design of the connector of the invention, besides the existing four connecting terminals and three pins, a plug is further included, and the plug includes the plurality of conductive rings. Therefore, compared to a connector of traditional ANSI 136.41 specification having only 7 pins, the connector of the invention further has the plug, the conductive rings thereof providing for definition of the control means and transmission of the high frequency signal. Furthermore, since the connector of the invention adds a plug based on a connector of existing ANSI 136.41 specification, the connector of the invention is compatible with existing lighting fixtures.

Although the invention has been described with reference to the above embodiments, it will be apparent to those skilled in the art that various modifications and variations can be made to the disclosed embodiments without departing from the scope or spirit of the invention. In view of the foregoing, it is intended that the invention covers modifications and variations provided that they fall within the scope of the following claims and their equivalents.

What is claimed is:

1. A connector suitable to be disposed on a lighting fixture, the connector comprising:

an insulated housing, having a containing space and a disposing surface, the disposing surface being located in the containing space;

four connecting terminals, separately disposed in the containing space of the insulated housing and located on the disposing surface;

three pins, separately disposed in the containing space of the insulated housing, and extending from the disposing surface toward a direction away from the disposing surface, the connecting terminals surrounding the pins; and a plug, disposed in a center of the containing space of the insulated housing and located on the disposing surface, the plug comprising a plurality of conductive rings, the conductive rings being separately arranged along the direction, and the pins surrounding the plug;

the conductive lings transmit a signal using an Internet of Things communication protocol.

2. The connector as recited in claim 1, wherein a first perpendicular height from each of the connecting terminals to the disposing surface is less than a second perpendicular height from each of the pins to the disposing surface, and a third perpendicular height from the plug to the disposing surface is less than the second perpendicular height and greater than the first perpendicular height.

3. The connector as recited in claim 1, wherein the pins comprise two first pins and one second pin, a width of the second pin is greater than a width of each of the first pins.

4. The connector as recited in claim 1, further comprising:

a base, assembled on the insulated housing and having a connection surface;

four connection pads, disposed on the connection surface of the base, the connecting terminals respectively connecting to the connection pads;

three pin slots, disposed on the connection surface of the base, the pins respectively being plugged into the pin slots; and a plug slot, disposed on the connection surface of the base, and having a plurality of conductive spring sheets, wherein the plug is plugged into the plug slot, such that the conductive rings respectively contact the conductive spring sheets.

5. The connector as recited in claim 4, wherein an external diameter of the base is less than an internal diameter of the insulated housing, and a portion of the base is located in the containing space of the insulated housing.

6. The connector as recited in claim 4, further comprising:

a plurality of transmission pins, disposed on another side of the base relatively away from the connection surface, and electrically connected to the connection pads, the pin slots, and the plug slot, respectively.

7. The connector as recited in claim 1, further comprising:

a control unit, disposed in the insulated housing, wherein the control unit comprises a light sensor or a wireless signal receiver.

8. The connector as recited in claim 1, further comprising:

an Internet of Things device, disposed in the insulated housing.

9. The connector as recited in claim 1, wherein the plug is a cylindrical plug.

* * * * *